US008181803B2

(12) United States Patent
Torrent Ortega

(10) Patent No.: US 8,181,803 B2
(45) Date of Patent: May 22, 2012

(54) MEANS FOR SEALING BOTTLE CAPS WITH EVIDENCE OF OPENING

(75) Inventor: David Torrent Ortega, Puerto de Santa Maria (ES)

(73) Assignee: Compania de Tapones Irrellenables, S.A., Puerto de Santa Maria (ES)

( * ) Notice: Subject to any disclaimer, the term of this patent is extended or adjusted under 35 U.S.C. 154(b) by 439 days.

(21) Appl. No.: 12/446,986

(22) PCT Filed: Oct. 26, 2007

(86) PCT No.: PCT/ES2007/000614

§ 371 (c)(1), (2), (4) Date: Apr. 24, 2009

(87) PCT Pub. No.: WO2008/049951

PCT Pub. Date: May 2, 2008

(65) Prior Publication Data

US 2009/0289027 A1 Nov. 26, 2009

(30) Foreign Application Priority Data

Oct. 26, 2006 (ES) ..... 200602732

(51) Int. Cl.

| | |
|---|---|
| ***B65D 49/02*** | (2006.01) |
| ***B65D 39/00*** | (2006.01) |
| ***B65D 41/00*** | (2006.01) |
| ***B65D 41/34*** | (2006.01) |
| ***B65D 53/00*** | (2006.01) |

(52) U.S. Cl. ..... 215/352; 215/21; 215/250; 215/251; 215/252; 215/253; 215/256; 215/329

(58) Field of Classification Search ..... 215/21, 215/250, 251, 252, 253, 256, 324, 329, 352; 220/214

See application file for complete search history.

(56) References Cited

U.S. PATENT DOCUMENTS

| | | | | |
|---|---|---|---|---|
| 4,454,954 | A | 6/1984 | Willis | |
| 6,276,544 | B1 * | 8/2001 | Battegazzore | 215/252 |
| 6,403,173 | B1 * | 6/2002 | Granger et al. | 428/34.1 |
| 6,929,137 | B1 * | 8/2005 | Granger et al. | 215/252 |
| 2005/0115915 | A1 * | 6/2005 | Thomson | 215/252 |
| 2006/0113272 | A1 * | 6/2006 | Rodriguez et al. | 215/252 |

FOREIGN PATENT DOCUMENTS

| | | |
|---|---|---|
| EP | 0574644 A1 | 12/1993 |
| GB | 1 262 743 | 2/1972 |
| WO | WO 02/096771 A | 12/2002 |
| WO | WO 03/104100 A | 12/2003 |

* cited by examiner

*Primary Examiner* — Anthony Stashick
*Assistant Examiner* — Madison L Wright
(74) *Attorney, Agent, or Firm* — Andrew D. Gerschutz; Tristan A. Fuierer; Moore & Van Allen, PLLC

(57) ABSTRACT

The present invention consists of an improvement made on the patent "Means for sealing bottle caps with evidence of opening" with Spanish application number P200202864, which made use of a concealed tongue that was revealed after the first opening without allowing to recover the original situation. The present invention maintains a connection between the top and bottom segments of the capsule, preventing their rotation relative to each other and providing an audible evidence of opening.

12 Claims, 4 Drawing Sheets

MEANS FOR SEALING BOTTLE CAPS WITH EVIDENCE OF OPENING

RELATED APPLICATIONS

This application is a 35 USC 371 national stage application based on international application PCT/ES2007/000614 filed Oct. 26, 2007, which claims priority from Spain Application P200602732 filed Oct. 26, 2006.

OBJECT OF THE INVENTION

The present invention consists of improvements made on the patent "Means for sealing bottle caps with evidence of opening", which used a concealed tongue that was revealed after the first opening, making the original situation irrecoverable.

The specific manner in which the evidence of opening is embodied in the base patent is through a breakable ring notched by a peripheral groove that gives rise to a tongue on the top and a peripheral lip on the bottom.

The presence of an outer capsule that is notched by a cut made in the groove joins the lower peripheral lip through the breakable ring and bends the tongue upward.

The first opening raises the top part of the capsule, releasing the tongue, which is lowered by elastic restoration force.

From the start, the upper and lower parts of the capsule are independent elements after the peripheral cut. This prevents their use for lateral printing of logos, as the rotation of one part with respect to the other before the first opening will deteriorate the image. As the two parts are independent, they can turn with respect to one another and become misaligned, giving the impression that the cap has been previously opened when this is not the case.

The present invention combines the solution for evidence of opening with temporary attachment of the upper and lower capsule parts.

BACKGROUND OF THE INVENTION

The base patent with Spanish application number P200202864 of the invention establishes means for evidencing the first opening that provide several advantages, the first of which is showing initially a large and flat surface and, after the first opening, showing a ring which can have a different colour from the capsule and thus will be easily seen, clearly showing that the cap has been opened.

This provides visual evidence. However, in this type of caps it is also important to provide audible evidence such that when the cap is turned to fully or partially open it, a snapping sound is heard that gives the impression that a breakable element has been snapped and therefore provides evidence that this is the first time the cap has been opened.

The cap of the base patent makes use of a lower ring to which it is connected by breakable bridges. This ring is peripherally grooved such that its lower part has a peripheral lip and such that above the groove a tongue is defined. Using different thicknesses will make the dimensions determine whether or not a lip is flexible; therefore, the lower peripheral lip and the tongue are not very different in their configuration, but are very different functionally. The latter has a greater flexibility.

After the mouth of the bottle has been sealed with the cap on the pourer, a single-body capsule is incorporated. A perimeter cutting action leaves the cut area notched into the groove of the ring placed under the cap.

In this way, the lower ring of the cap is connected by breakable bridges to the cap, while the two parts of the capsule defined by the cut support the same ring.

The lower skirt or bottom part of the capsule holds the ring with respect to the bottle through the lower peripheral lip, and the tongue is bent and held upward in the perimeter cutting operation by the upper segment of the capsule.

The opening operation implies a rotation and axial displacement due to the helical motion imposed by the thread.

In the first opening, the rotation and axial displacement break the breakable bridges of the grooved ring, as the latter is retained on the bottom by the lower part of the capsule. The breaking produces a snapping sound.

In turn, the axial displacement forces the fixed tongue joined to the grooved ring to be separated from the upper part of the capsule that is rising. Initially, when it is forced upward the tongue will restore its position elastically, producing a second snapping sound.

In addition, the elastic restoration of the tongue covers the upper edge of the lower part of the capsule when it descends. This prevents the edges of the bottom part of the capsule from cutting, as they are concealed by the tongue.

After closing, the tongue cannot be introduced in the top part of the capsule and hence it is interposed between the capsule segments and is externally visible.

In this way, the evidence of opening can be seen by the presence of the tongue and heard by the two snapping sounds generated.

In this solution, as the peripheral cut fully separates the upper and lower parts of the capsule, it is not advisable to print the sides of the capsule as the images that are on both the upper and lower parts of the cutting line can be misaligned, creating a discontinuity of the image and preventing its use from a commercial standpoint.

Similarly, the snapping sound of the tongue is reduced when the bottle has been filled a long time before, as the elastic restoration is not as quick.

The present invention provides a means for combining the solution of the base patent for providing evidence of opening and others involving the connection of the capsule segments in order to overcome the two aforementioned disadvantages.

DESCRIPTION OF THE INVENTION

The present invention overcomes the cited disadvantages in the state of the art, mainly comprised of the base patent, by modifying the peripheral cutting of the capsule.

The starting point is a configuration given by the cap of the base patent P200202864 with publication number ES2234378, the description of which is included in this memory for reference purposes.

After manufacturing the various parts that comprise the cap with the safety means that it can have, these are inserted in the capsule.

It is possible to perform a peripheral cutting of the assembly covered by the capsule with a discontinuous cutting that defines notched segments in the groove and uncut segments that define breakable bridges. At this time the lower edge of the capsule is also notched to retain the assembly inserted in said capsule and with a good finish.

This cut must not simply separate the top and bottom parts in the segments where the cut is made; in addition, the notching must bend the tongue upward as in the base patent. On the bottom, the notch must continue to support the lower peripheral lip of the grooved ring.

The points or segments where no cut is made define breakable bridges that do not affect the behaviour of the tongue.

A possible execution with improved results involves separating the notching and cutting operations. In this way, the notching is performed first, followed by the discontinuous cut.

The advantage of this strategy is that the breakable bridges, instead of being external and coinciding with the cylindrical surface, are also notched on the inside. By being on the inside, the uncut segments that act as breakable bridges are also segments that retain the tongue, further ensuring the behaviour in accordance with the base patent.

After the first opening, these breakable bridges rip generating a third snapping sound that is added to the two sounds described in the background section. Before the opening, they maintain a connection between the top and bottom parts of the capsule to prevent a misalignment due to rotation that would deteriorate images that extend on both the top and bottom parts of the capsule, giving for example the false impression that the cap has been opened, when this has not been the case.

Although the snapping sound generated by the breakable bridges is referred to as a "third snapping sound", this does not mean that it is generated in third place in time; this is only to differentiate it from the other two sounds described above. In fact, these bridges will typically be the first to break and therefore the third snapping sound will occur in first place.

The description of a preferred embodiment section refers to the use of caps that do not allow refilling with a valve device, a valve with one sphere and a valve with two spheres to increase safety as there are more blocking elements.

By way of summary, it can be said that the essential components of the invention consist of sealing means for bottle caps with evidence of opening consisting at least of one threaded cap to be placed on the mouth of a bottle, provided on its bottom with a grooved ring connected by breakable bridges, the assembly as a whole being covered by a capsule that is notched at the level of the grooved ring, the notching being achieved by discontinuous cutting such that two segments can be differentiated:

- cut segments in which the lips of the edges generated maintain the ring connected to the bottle on the bottom and the tongue bent upwards and concealed on the top;
- and at least one uncut segment that connects the top and bottom segments of the capsule, preventing their relative rotation;

such that the uncut segment(s) do not modify the release process of the tongue retained in the cut segments.

DESCRIPTION OF THE DRAWINGS

The present descriptive memory is completed by a set of drawings that illustrate the preferred embodiment and in no way limit the invention.

In FIG. 2 a sphere is incorporated under the inner valve and in FIG. 3 two spheres are incorporated as additional blocking means. The figure includes an enlarged detail of the peripheral groove and the tongue.

DETAILED DESCRIPTION OF THE INVENTION

Figure 1:
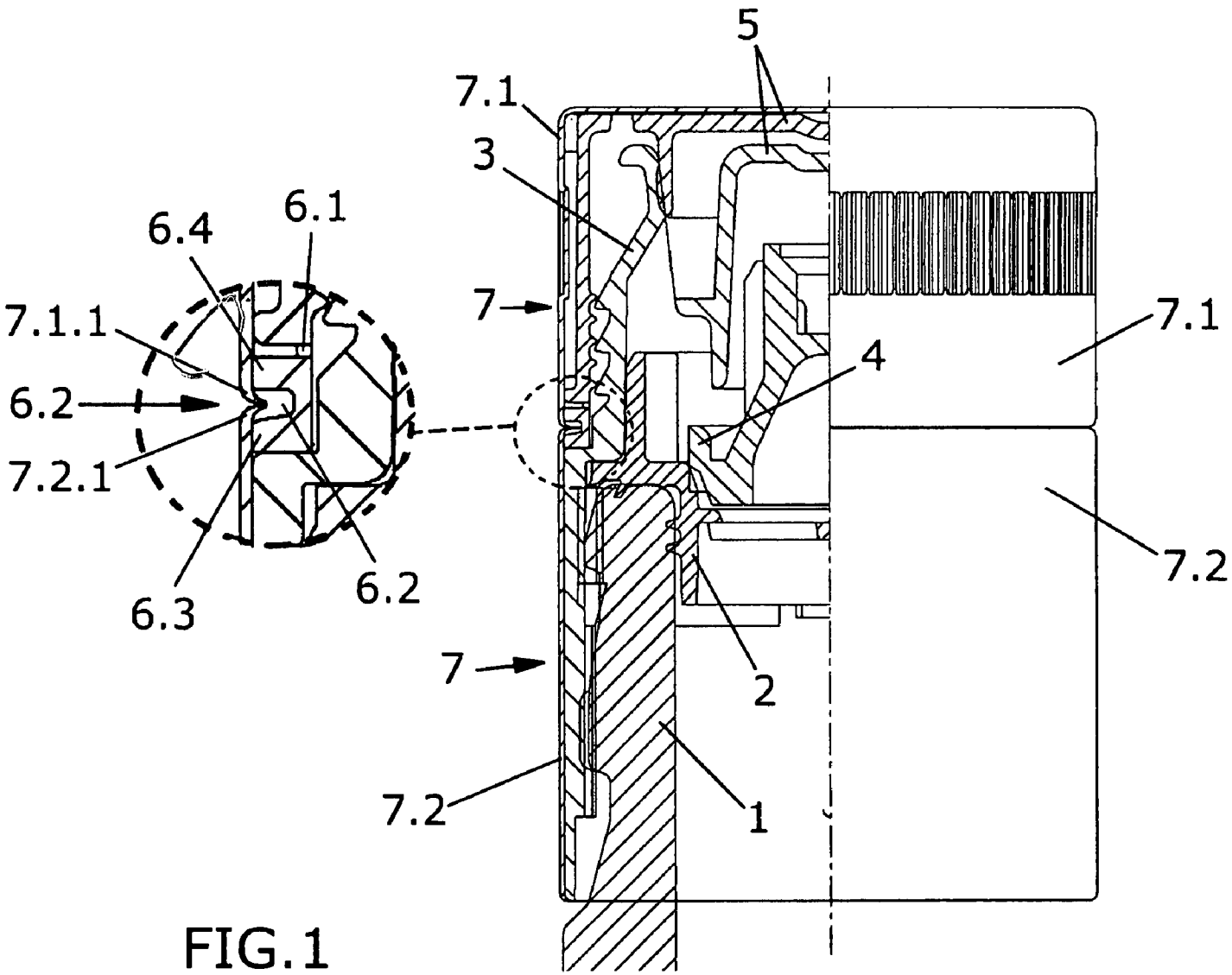
FIG. 1 shows an example of embodiment of a cap such as that of the state of the art with a continuous peripheral cut. The figure includes an enlarged view of the area of the peripheral groove and the tongue.

FIG. 1 shows an example cap embodied according to the base patent from which this addition is derived, in which a safety mechanism is incorporated to the mouth of the bottle (1) to prevent a fraudulent refill.

This safety mechanism is constituted by a valve (4) placed on a chassis (2) that completes labyrinth channels which communicate the inside and outside of the bottle (1) after passing through a pourer (3).

On top of this assembly is a threaded cap (5) that ensures the seal with the mouth of the pourer (3).

This threaded cap (5) is provided on its bottom with a grooved ring (6) such that the threaded cap (5) and the ring (6) are connected by breakable bridges (6.1).

Covering the entire assembly is the single-piece capsule (7) which after a continuous peripheral cut at the level of the groove (6.2) of the grooved ring (6) is separated into two segments, a top segment (7.1) and a bottom segment (7.2), now independent.

Each of these segments (7.1, 7.2) of the capsule have corresponding edges (7.1.1, 7.2.1) that are notched inside the groove (6.2).

The lip of the upper edge (7.2.1) of the bottom segment (7.2) holds the ring (6) by the lower peripheral lip (6.3) joining it to the neck of the bottle (1).

The lip of the bottom edge (7.1.1) of the top segment (7.1), during the peripheral cutting, bends the tongue (6.4) upwards and keeps it bent.

After the first opening, the tongue (6.4) is released and recovers its position elastically, thereby moving down.

Figure 2:
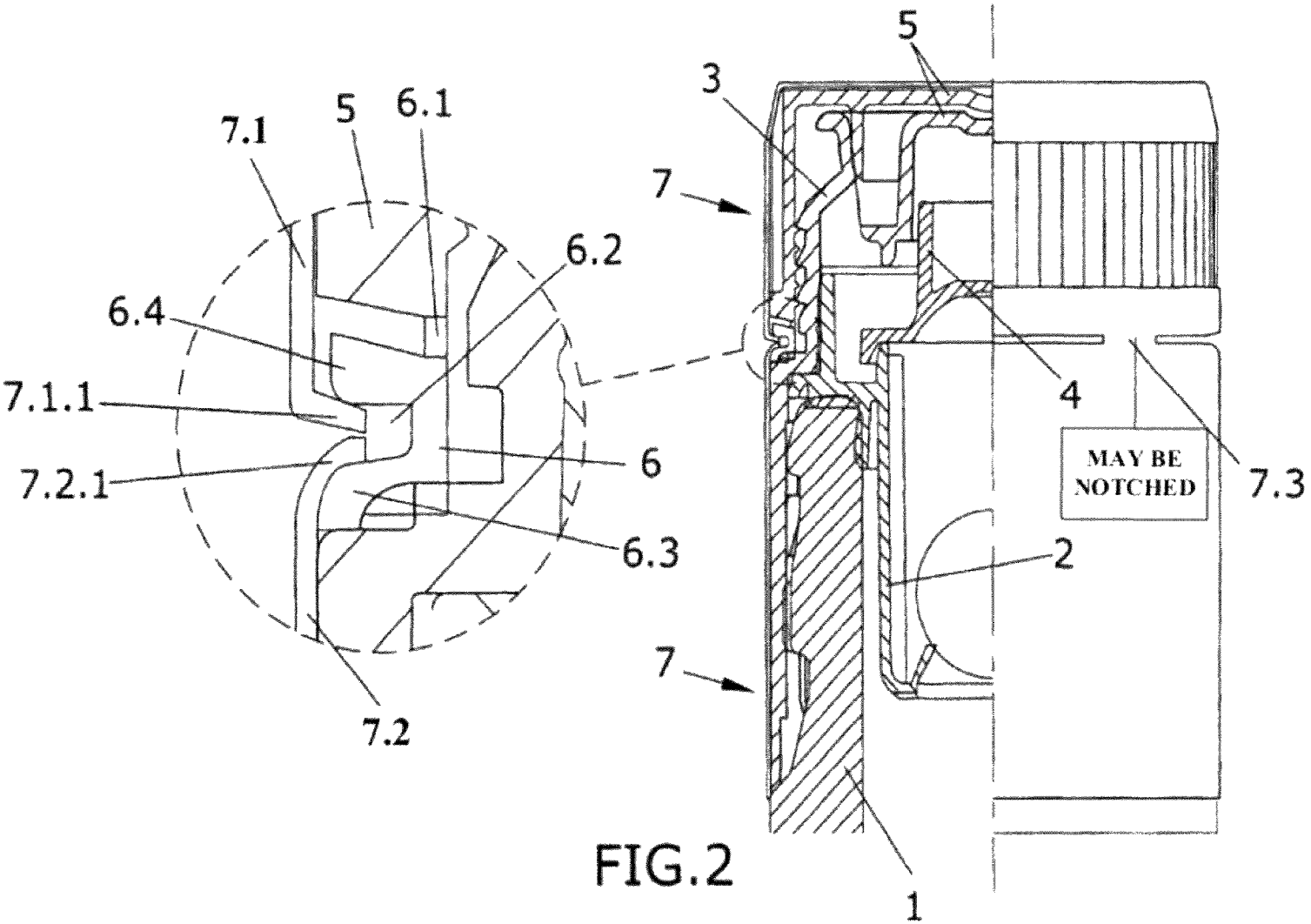
FIGS. 2 and 3 show an example of embodiment of a cap with a cut as proposed in the present invention.
Figure 3:
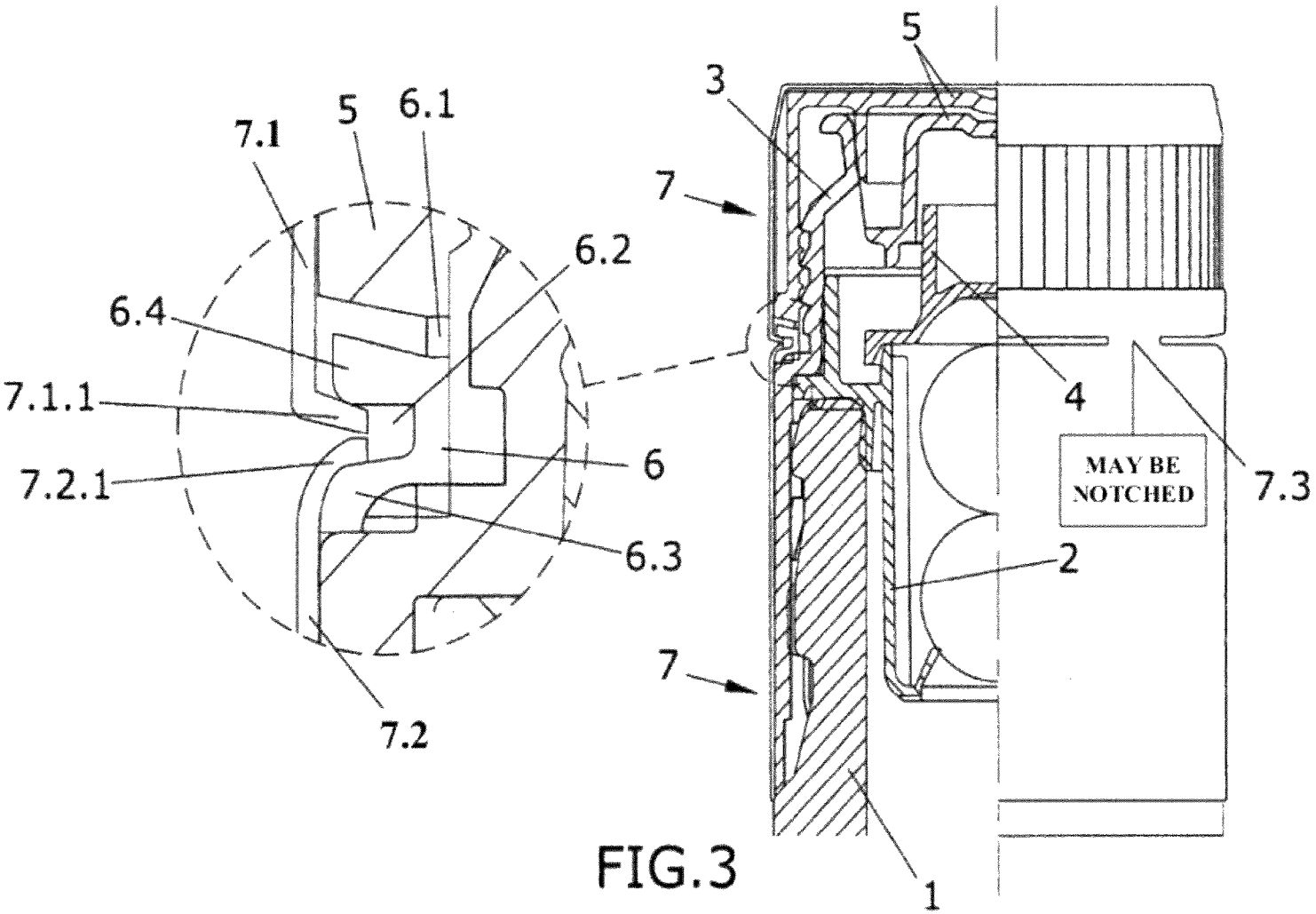

FIGS. 2 and 3 show examples of embodiments of the same invention differing only in the use of a valve (4) without a sphere and the use of a valve (4) with one or two spheres, according to the safety level required to prevent fraudulent refills.

The components used are the same as those used in the state of the art, with the exception of the cutting method and the resulting configuration.

Both figures show the discontinuous cut. In this way, the top and bottom parts of the capsule remain connected, preventing their relative rotation.

The cut must be made such that it takes place at areas where there is a notch with the lips (7.1.1, 7.2.1) of the edges holding the peripheral lip (6.3) and the tongue (6.4), while the uncut segments must be sufficiently narrow to allow breaking by shearing. This example uses three evenly spaced uncut segments (7.3).

The breaking of the breakable bridges (6.1) between the cap (5) and the grooved ring (6) takes place by a combined separation action resulting from the axial displacement and the rotation of the cap (5). The ring does not have to be retained in the rotation by the lip of the edge (7.2.1) of the bottom segment (7.2), so that the breakage will mainly result from the separation.

On the contrary, in the capsule (7) the uncut segments are broken mainly by the rotation.

This is a very important fact, as without the presence of the connection points between the segments (7.1, 7.2) of the capsule (7.1) it is possible, as is the case in the state of the art, to make a small turn that results in an almost imperceptible axial displacement that cannot even break the breakable bridges (6.1) between the ring (6) and the cap (5) nor release the tongue (6.4).

In the invention, this small rotation would lead to breaking the discontinuity segments generated by the discontinuous cut, providing evidence of the attempted opening even if it has not taken place in full.

Figure 4:
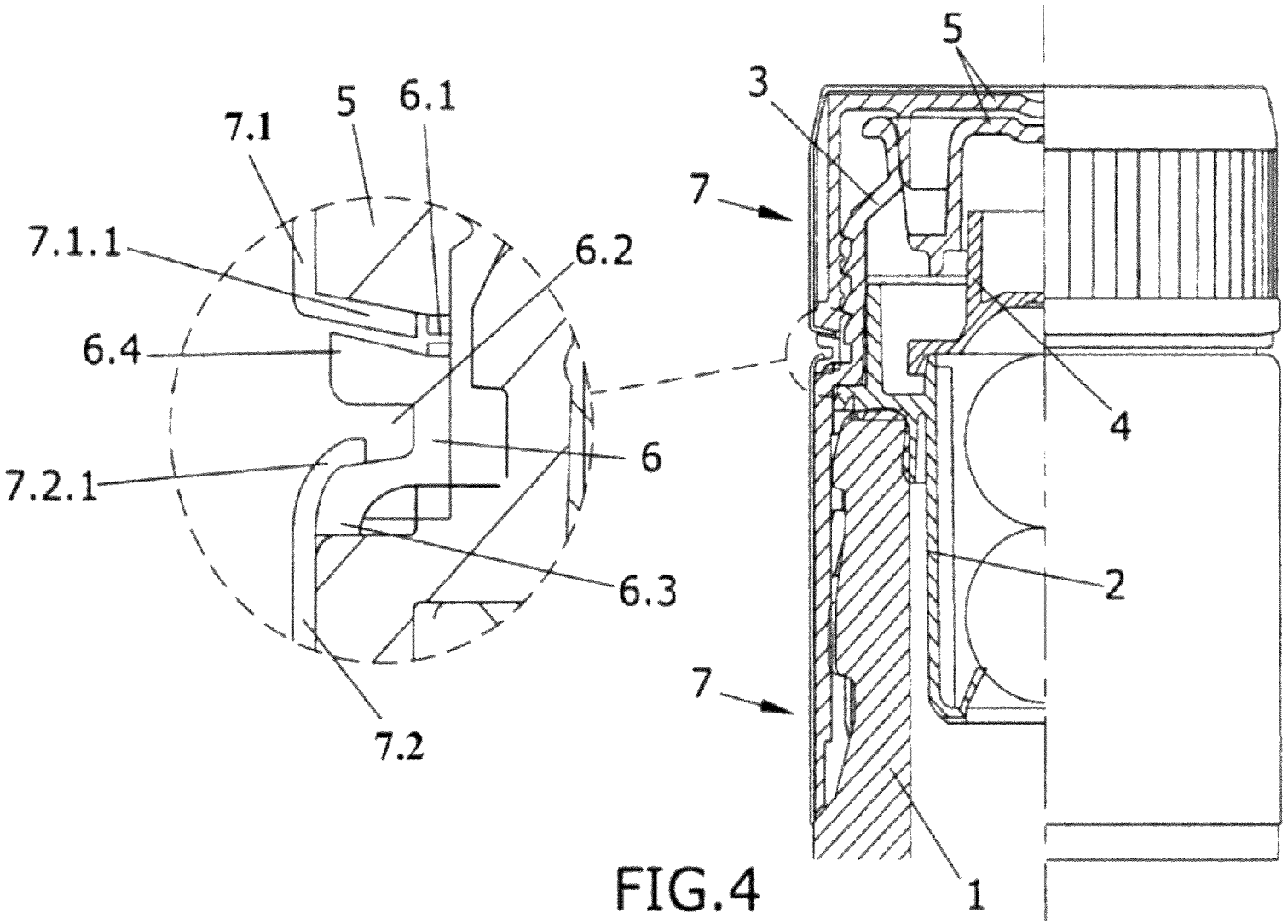
FIG. 4 shows the same example as in FIG. 3, representing the position adopted by the lip of the upper segment of the capsule and the tongue. The figure includes an enlarged detail of the area of the peripheral groove and the tongue.

FIG. 4 shows an enlarged view of the seal after the first opening, reproducing the situation of the base patent, as the invention consists of ensuring the same mode of operation even with points of connection between the top and bottom parts of the capsule, where there is no retention of the tongue nor of the bottom peripheral lip.

The invention claimed is:

1. Means for sealing bottle caps with evidence of opening, comprising:

a threaded cap (5) to be placed on a mouth of a bottle (1), wherein a bottom portion of the threaded cap (5) is provided with a grooved ring (6) having an upper tongue (6.4), wherein the threaded cap (5) and the grooved ring (6) are connected by breakable bridges (6.1); and a capsule (7) covering the threaded cap (5), wherein the capsule (7) includes at least one cut segment and at least one uncut segment (7.3), wherein the at least one cut segment is notched by a cut at a height of the grooved ring (6) and separates the capsule into a top segment (7.1) and a bottom segment (7.2), wherein the top segment (7.1) includes a top lip (7.1.1) configured to maintain the upper tongue (6.4) bent upwards and concealed and the bottom segment (7.2) includes a bottom lip (7.2.1) configured to maintain the grooved ring (6) in the bottom segment (7.2); and wherein the at least one uncut segment (7.3) connects the top segment (7.1) and the bottom segment (7.2) of the capsule (7) preventing their rotation relative to each other such that the at least one uncut segment (7.3) does not modify the process of releasing the upper tongue (6.4) retained in the cut segment.

2. Means for sealing bottle caps with evidence of opening according to claim 1, further comprising incorporated safety means for preventing fraudulent refilling.

3. Means for sealing bottle caps with evidence of opening according to claim 2, wherein said safety means for preventing fraudulent refilling comprises a pourer (3) that incorporates a valve (4) and a chassis (2).

4. Means for sealing bottle caps with evidence of opening according to claim 3, wherein incorporated under the valve (4) is a sphere.

5. Means for sealing bottle caps with evidence of opening according to claim 3, wherein incorporated under the valve (4) are two spheres.

6. Means for sealing bottle caps with evidence of opening according to claim 1, wherein segments connecting the top and bottom segments are evenly spaced.

7. Means for sealing bottle caps with evidence of opening according to claim 1, wherein segments connecting the top and bottom segments are three in number.

8. Means for sealing bottle caps with evidence of opening according to claim 6, wherein the segments that connect the top and bottom segments are three in number.

9. Means for sealing bottle caps with evidence of opening according to claim 1, wherein the uncut segments produce an audible evidence of opening.

10. Means for sealing bottle caps with evidence of opening according to claim 1, wherein the cut segments are notched.

11. Means for sealing bottle caps with evidence of opening according to claim 1, wherein both the cut and uncut segments are notched.

12. Means for sealing bottle caps with evidence of opening according to claim 1, wherein after a first opening, the upper tongue (6.4) is released and positioned so that said upper tongue (6.4) covers the bottom lip (7.2.1) of the bottom segment (7.2) of the capsule (7) and the top lip (7.1.1) of the upper segment (7.1) of the capsule (7) is placed over the upper tongue (6.4).

* * * * *